US005198826A

United States Patent [19]

Ito

[11] Patent Number: 5,198,826

[45] Date of Patent: Mar. 30, 1993

[54] WIDE-BAND LOOP ANTENNA WITH OUTER AND INNER LOOP CONDUCTORS

[75] Inventor: Michiaki Ito, Nogaoka, Japan

[73] Assignee: Nippon Sheet Glass Co., Ltd., Osaka, Japan

[21] Appl. No.: 581,893

[22] Filed: Sep. 13, 1990

[30] Foreign Application Priority Data

Sep. 22, 1989 [JP] Japan ..... 1-247254
Sep. 27, 1989 [JP] Japan ..... 1-251579
Sep. 28, 1989 [JP] Japan ..... 1-253158

[51] Int. Cl.[5] ..... H01Q 1/38; H01Q 21/00

[52] U.S. Cl. ..... 343/726; 343/713; 343/742

[58] Field of Search ..... 343/713, 730, 726, 742, 343/728, 843, 833, 834, 873

[56] References Cited

U.S. PATENT DOCUMENTS 3,096,518 7/1963 Tiikkainen ..... 343/873
4,003,056 1/1977 Davis ..... 343/713
4,160,977 7/1979 Davis ..... 343/713
4,331,961 5/1982 Davis ..... 343/713
4,701,764 10/1987 Malcombe ..... 343/742
4,872,018 10/1989 Feltz et al. ..... 343/742

FOREIGN PATENT DOCUMENTS 654142 6/1951 United Kingdom ..... 343/742
1485219 9/1977 United Kingdom ..... 343/742

*Primary Examiner*—Michael C. Wimer
*Attorney, Agent, or Firm*—Woodcock, Washburn Kurtz Mackiewicz & Norris

[57] ABSTRACT

A wide-band loop antenna consists of a main loop antenna conductor and a sub-loop antenna conductor. The main loop antenna conductor is provided on a dielectric plate to extend from one terminal of a pair of feed terminals to another one of the terminals so as to form a one-turn open loop. The loop antenna conductor is provided on the dielectric plate so as to extend along the main antenna conductor to provide a one-turn open loop and is connected to the pair of feed terminals to constitute a synthesized antenna together with the main antenna conductor. Short-circuting conductors are provided to connect the main antenna conductor with the sub-antenna conductor for shifting a resonance frequency of the synthesized antenna outside the operating band to obtain a wide-band frequency characteristic. In a modification, the sub-antenna conductor forms a closed loop serving as a parasitic antenna which improves an impedance characteristic of the main antenna conductor.

6 Claims, 9 Drawing Sheets

WIDE-BAND LOOP ANTENNA WITH OUTER AND INNER LOOP CONDUCTORS

BACKGROUND OF THE INVENTION

1. Field of the Invention

The present invention relates to a wide-band loop antenna and, more particularly, is directed to a wide-band loop antenna which is preferably applied to a glass window antenna of a motor vehicle.

2. Description of the Prior Art

A glass window antenna attached on a widow glass of a motor vehicle is well-known. The antenna comprises a conductor arranged on the window glass to feed a reception signal to an AM radio receiver, an FM radio receiver or a TV receiver mounted in a automobile (refer to for example, Japanese patent publication No. 33951/1975 and Japanese patent laid-open application No. 44541/1977). The antenna conductor is usually arranged on a rear window glass having relatively large area. The central portion of the rear window however is necessary to ensure rear view of a driver. It is therefore undesirable to attach the antenna conductor on the central portion. Further, defogging heater conductors are usually provided on the central portion so that the antenna conductor can not be attached on that portion. The antenna conductor therefore must be arranged in a narrow blank area upper or lower the defogging heater conductors.

It is difficult on that narrow blank area to wire the antenna conductor complexly or to add an array of parasitic elements as the Yagi-Uda antenna for obtaining a wide-band characteristic. It is therefore difficult to provide to a conventional window glass antenna a good frequency characteistic over a whole range of FM broadcast band.

Mean while, a loop antenna is known as one having relatively wide-band characteristic though it is considerably simple. The loop antenna is advantageous as it can be arranged along the periphery of a glass having heater conductors on the central area thereof.

The loop antenna however has not so wide-band characteristic to cover a considerable wide range for example from an FM broadcast band to a TV broadcast band. Two or more antennas must be provided on a glass window to receive reception power and feed to receivers such as an FM radio receiver and a TV receiver when both of them are mounted in an automobile. In addition, feeder cables for feeding reception power to the receivers must be attached to each of the antennas. The feeder cables make the peripheries of the window complicated and.

The loop antenna furthermore has a defect in that it has a high output impedance as large as 300 [Ω] for an oblong rectangle loop antenna with a power feed point at a longer side when used in FM broadcast reception. Sensitivity is lowered due to mismatching of impedance when a coaxial feeder cable of 50 [Ω] is directly connected to the feed terminal. A specialized matching circuit must be provided between the loop antenna and the feeder cable to match the impedance in the prior art.

OBJECT AND SUMMARY OF THE INVENTION

Accordingly, it is a primary object of the present invention to provide a wide-band loop antenna having a good reception sensitivity over a wide frequency range.

It is a practical object of this invention to provide a wide-band loop antenna consisting of a first loop antenna and one or more additional loop antennas connected in parallel with the first antenna and operating as a single antenna.

It is another object of this invention to remove a dip in sensitivity in a reception band of the single synthesized antenna consisting of a loop antenna and a parallel connected additional loop antenna.

It is still another object of this invention to improve degradation in sensibility due to interference between antennas consisting of a loop antenna and a parallel connected additional loop antenna.

It is still another object of this invention to provide a wide-band loop antenna consisting of a loop antenna and an additional antenna connected to the former to improve an impedance characteristic.

According to an aspect of this invention, a wide-band loop antenna consists of a main loop antenna conductor and a subsidiary-loop antenna conductor. The main loop antenna conductor is provided on a dielectric plate and extends from one feed terminal to another feed terminal to form a one-turn open loop configuration. The subsidiary-loop antenna conductor is also provided on the dielectric plate and extends along the main antenna conductor to provide a one-turn open loop and is connected at both its ends to the feed terminals, along with the main loop, to provide a closed loop or circuit. These two loop antenna conductors interact with each other. Means for determining an interaction is applied between the two loop antenna conductors to effect the transmission/reception characteristic of the antenna system.

According to another aspect of this invention, respective ends of the subsidiary-loop antenna conductor are connected to the pair of feed terminals to be coupled in parallel with the main loop antenna conductor so that a synthesized antenna has a wide-band frequency characteristic.

The means for determining the interaction comprises a short-circuiting line to connect said main loop antenna conductor with said subsidiary-loop antenna conductor at a position adjacent the feed terminals. The short-circuiting line divides the closed loop formed parasitically between the main and sub-loop antenna conductors into two rectangular loops and a C-shaped loop to move the high order harmonic oscillation frequency outside an operating band. A resonance current which degrades an impedance characteristic of the antenna is prevented from being generated within the operating band.

According to another aspect of this invention, a non-loop antenna conductor consisting of for example, a dipole antenna is connected to the pair of feed terminals. The non-loop antenna conductor has a resonance frequency located within one of the frequency bands except in the vicinity of frequencies which are multiples of a natural oscillation frequency of said loop antenna conductors.

The loop antenna conductor has a high impedance in frequency bands except the vicinities of frequencies which are multiples of a natural oscillation frequency of the loop antenna. The loop antenna dose not interfere with the non-loop antenna in an operation band of the non-loop antenna.

According to another aspect of this invention, said subsidiary-loop antenna conductor comprises a parasitic closed loop arranged along inside said main loop antenna conductor and said means for determining the interaction comprises a spacing interval between said main and sub-loop conductors, said interval being set less than 1/100 of a wavelength of a transmission/reception wave.

When the interval of the main and parasitic loops is reduced to as small as 1/100 of a wavelength of the operating frequency of the loop antenna, respective resonance frequencies of the loops come near to each other. They operate as a single loop antenna as if it is formed of a solid strip line having a width corresponding to the interval between the loops. Input impedance at resonance is influenced by a conductor width of the antenna element. Generally, the thicker a conductor width becomes, the smaller the input impedance becomes. In addition, a loop antenna is regarded as it consists of two half-wavelength dipole antennas formed on opposing sides of a rectangle. Mutual coupling between these dipole antennas is reduced due to insertion of the parasitic closed loop conductor so that mutual impedance therebetween is reduced. Choice of the interval between the main and parasitic loops makes it possible to match the impedance with a characteristic impedance of a feeder cable.

The above, and other, objects, features and advantages of the present invention, will become readily apparent from the following detailed description thereof which is to be read in connection with the accompanying drawings.

DETAILED DESCRIPTION OF A PREFERRED EMBODIMENT

Figure 1:
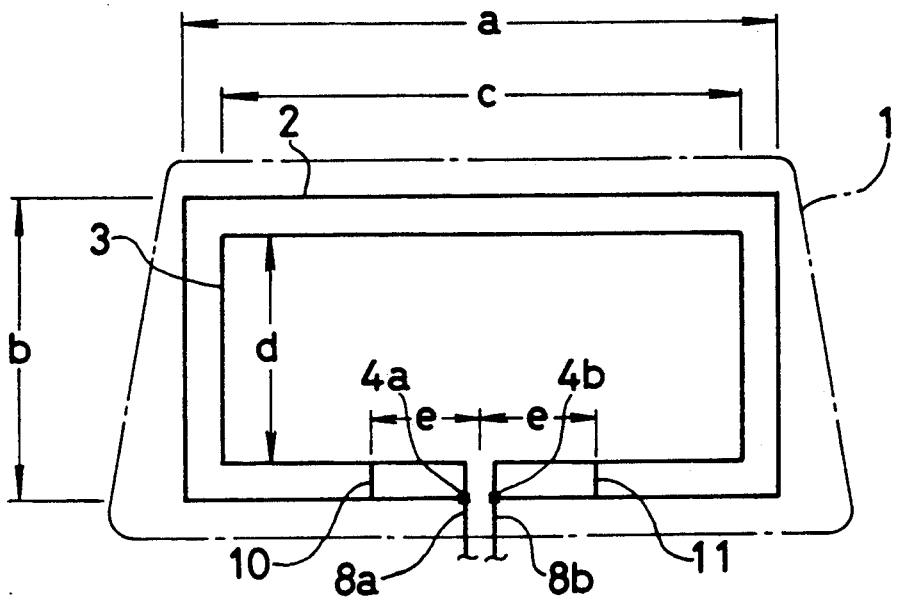
FIG. 1 is a front view of a rear glass window of an automobile according the first embodiment of this invention.

FIG. 1 is a front view of a rear window glass of an automobile according to an embodiment of this invention. Antenna conductors are arranged on an inner surface of the rear window glass 1 to serve as a glass window antenna for FM broadcast wave reception. In this embodiment, loop antennas 2 and 3 are provided along a periphery of the rear window glass 1 by a print wiring process to form a double loop arrangement with similar figures to the window glass. The window glass 1 is generally an oblong rectangle so that both the outer loop antenna and the inner loop antenna 3 are rectangular similar to the window.

Feed terminals **4*a* and 4*b* are provided on the surface of the rear window glass 1 to derive reception power from the outer loop antenna 2 as a main antenna and the inner loop antenna 3 as a subsidiary-antenna. The feed terminals 4*a* and 4*b*** are arranged at the center of a longer side to increase reception efficiency for FM broadcast waves which are horizontally polarized waves in Japan.

When a glass window antenna is arranged on a glass surface by a print wiring process, the propagation velocity of an RF current flowing through the antenna conductor is reduced due to dielectric constant of the glass. The wavelength of an RF current flowing through the outer loop antenna 2 and the inner loop antenna 3 is shorter than that of an RF current flowing through a conductor in a vacuum at the same frequency. This shortening effect should be considered when designing a glass antenna. For the sake of simplifying illustration, an embodiment will be explained by referring to numerical values changed to lengths of conductors in a vacuum.

In FIG. 1, lengths of the outer loop antenna 2 are given: $a=1{,}250$ mm for a longer side and $b=625$ mm for a shorter side. Lengths of the inner loop antenna 3 are given: $c=1{,}130$ mm for a longer side and $d=505$ mm for a shorter side. The loop antennas 2 and 3 are coupled in parallel with each other to the pair of feed terminals **4*a* and 4*b* at both ends of the loops. Feeder lines 8*a* and 8*b*, are connected to the feed terminals 4*a* and 4*b***.

Figure 2:
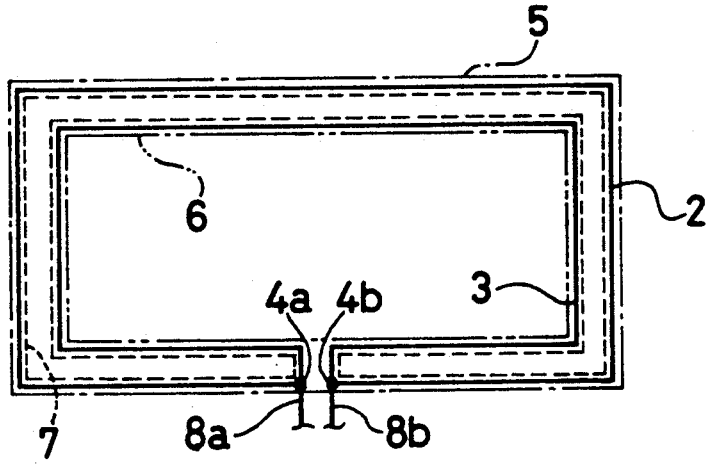
FIG. 2 is an illustration of antenna conductor pattern showing closed loops produced by parallel connected two loop antenna conductors.

As shown by a closed loop illustration of FIG. 2, it appears that a third closed loop 7 is parasitically formed in addition to a main loop 5 corresponding to the outer loop antenna 2 and a subsidiary-loop 6 corresponding to the inner loop antenna 3. A loop length of the third loop 7 corresponds to a sum of the lengths of the main loop 5 and the subsidiary-loop 6 and is about 7,140 mm. Therefore, the third loop 7 theoretically has a resonance frequency of 84 MHz when it operates as a second harmonic antenna. A degraded dip is generated in an impedance characteristic between the resonance frequency of the main loop 5 and the resonance frequency of the sub-loop 6.

To improve the disadvantage, in this embodiment, short-circuit lines 10 and 11 are provided as shown in FIG. 1 to give short-circuits between the outer loop antenna 2 and the inner loop antenna 3 for shortening the third loop 7. The second harmonic resonance frequency of the third loop 7 is shifted upward outside the operation band. The degrading of input impedance characteristic due to the third loop 7 is improved so that a glass antenna with sufficient wide-band characteristic is obtained.

According to an experiment, a good wide-band characteristic is obtained with the distances $e=312.5$ mm from respective feed terminals **4*a* and 4*b* to the short-circuiting points. A graph showing variation of input reflection versus frequency is plotted in FIG. 3 for the case where a short-circuited double rectangle loop antenna having a figure as above is coupled to feeder lines 8*a* and 8*b*** having a characteistic impedance of 200 (Ω).

Figure 3:
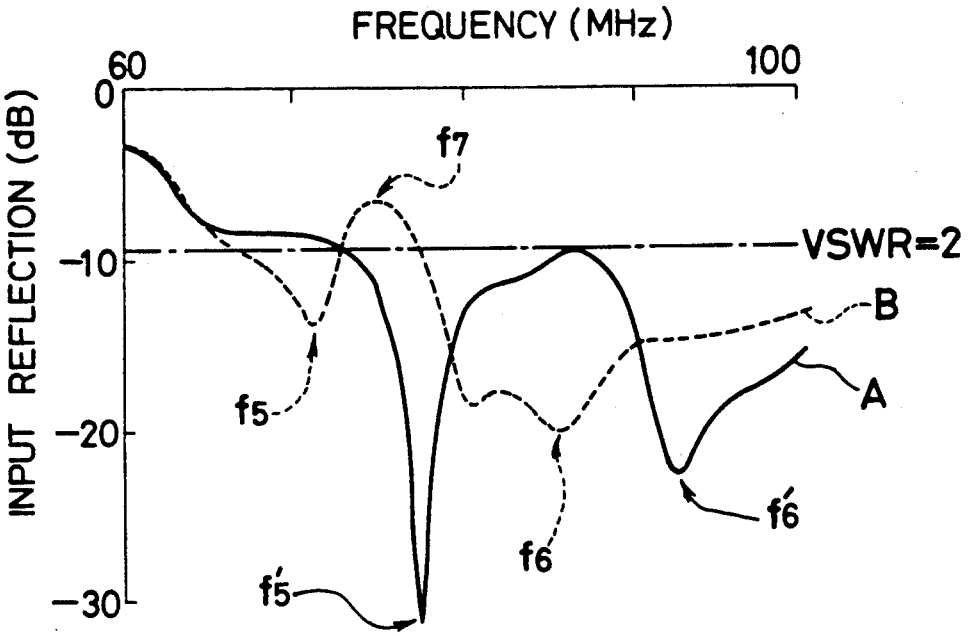
FIG. 3 is a graph of a reflection characteristic of the loop antenna of FIG. 1 in an FM broadcast band.

In FIG. 3, a solid curve A shows a characteristic of the glass antenna of the embodiment in FIG. 1 and a dotted curve B shows that of a glass antenna having a conductor pattern of FIG. 2.

Dip portions $f_5$ and $f_6$ correspond to resonance points of the main loop and the subsidiary-loop 6 of FIG. 2. A peak point $f_7$ corresponds to a degraded portion of impedance due to the second order harmonic resonance of the third loop 7. At the peak point $f_7$, reflection is remarkably large and a voltage standing wave ratio VSWR is more than 2 so that the antenna dose not operate properly.

Dip portions $f_5'$ and $f_6'$ on a curve A in FIG. 3 correspond to $f_5$ and $f_6$ of the curve B showing resonance points of the main loop 5 and sub-loop 6. The second harmonic resonance point of the third loop 7 is shifted outside the operative band due to the short-circuit lines 10 and 11 so that a VSWR between the dip points $f_5'$ and $f_6'$ is reduced to less than 2.

The short-circuited double loop antenna of FIG. 1 therefore has a wide-band characteristic with a VSWR less than 2 in a band of 73–100 MHz. The bandwidth ratio is 30% by measure and is six times larger than the bandwidth ratio 5.3% of a single loop antenna. The short-circuited double loop antenna of the embodiment therefore has sufficient performance as an FM broadcast reception antenna.

Figure 4:
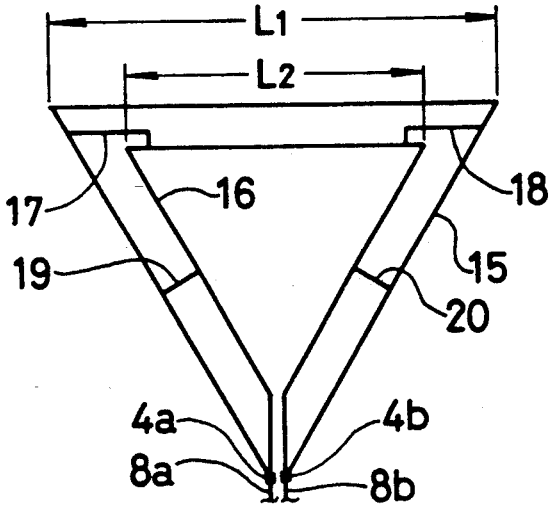
FIG. 4 is a view of antenna pattern showing a modification different from FIG. 1.

Next, a modification is illustrated by referring to a conductor pattern of FIG. 4 in which this invention is applied to a VHF band-TV broadcast wave reception antenna. An antenna in a UHF band can be small-sized as wavelength on this band is short, so that the antenna can be arranged in a small area. A short-circuited double triangle loop antenna is formed on a side window glass in the embodiment of FIG. 4. The outer loop antenna 15 is an equilateral triangle with a side length $L_1=250$ mm and an inner loop antenna 16 with a side length $L_2=166$ mm. The outer loop antenna 15 resonates with a wave of 400 MHz and inner loop antenna 16 resonates with a wave of 600 MHz, individually.

Common feed terminals 4*a* and 4*b* are provided at the lowermost vertex of the triangle of FIG. 4 of the loop antennas 15 and 16. The outer loop antenna 15 and the inner loop antenna 16 are short-circuited by four short-circuiting lines 17–20 located respectively at both ends of the side opposing the feed terminals 4*a* and 4*b* and at both centers of sides having the feed terminals 4*a* and 4*b*.

Figure 5:
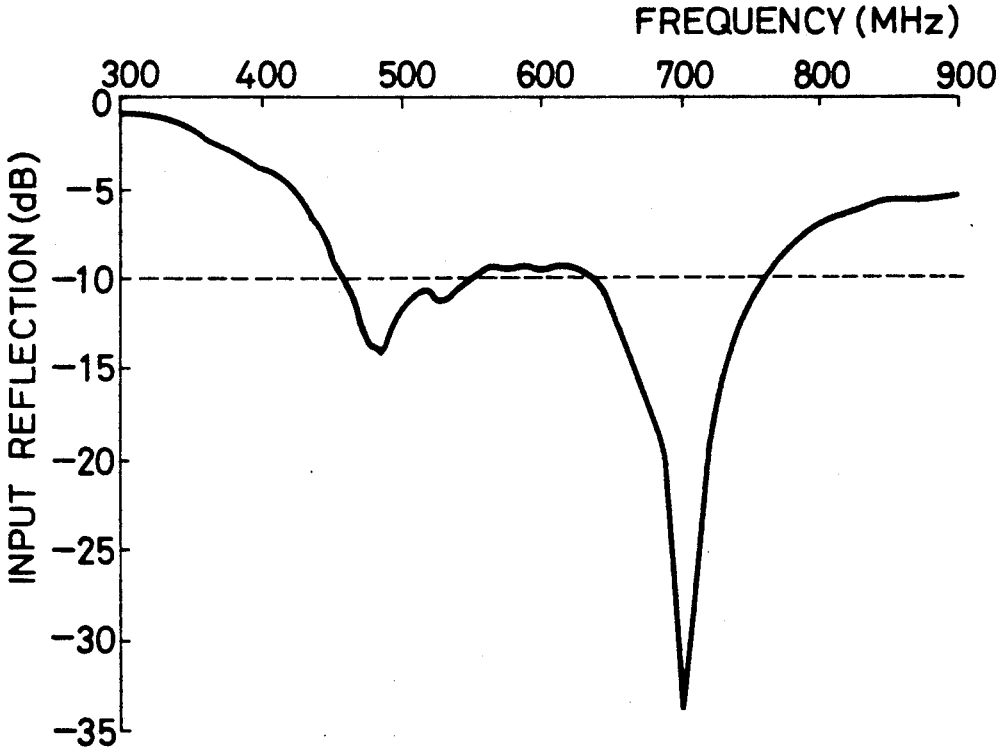
FIG. 5 is a graph of a reflection characteristic of the loop antenna of FIG. 4 operated in an UHF-TV broadcast band.

The input reflection characteristic of the short circuited double triangle loop antenna with the above figure is shown in FIG. 5. This antenna shows a good reception characteristic over a whole range of UHF TV broadcast band from 470 MHz to 770 MHz.

In the above embodiments, rectangle and equilateral triangle loop antennas are illustrated. Other loop figures may be applied, such as a circular loop, for example.

Figure 6A:
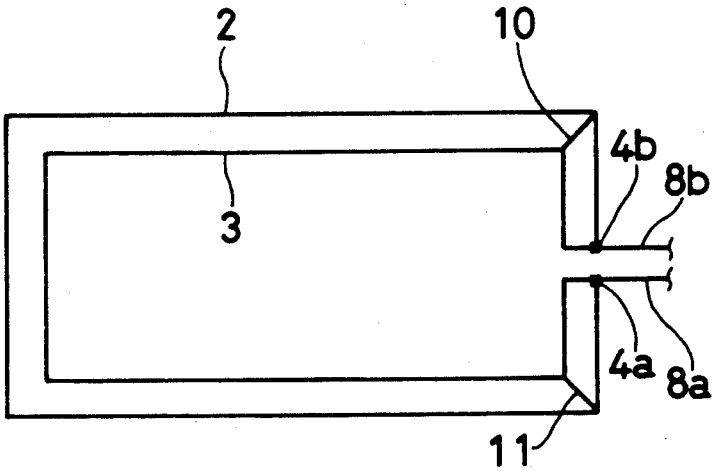
FIGS. 6A–6C are views showing various types of location of feeding points.
Figure 6B:
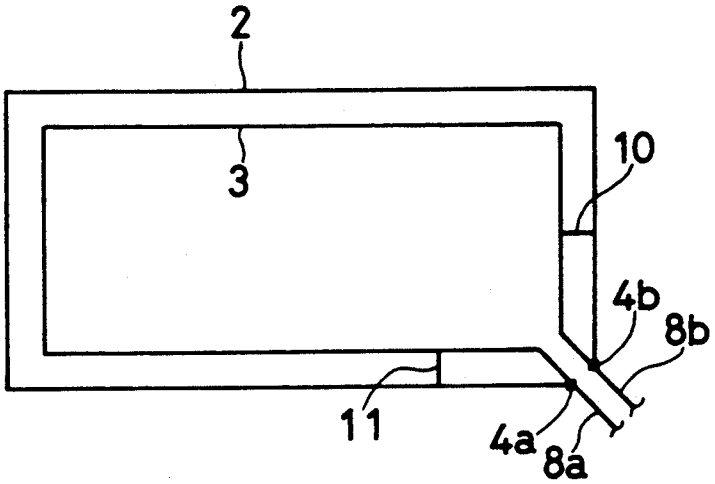
Figure 6C:
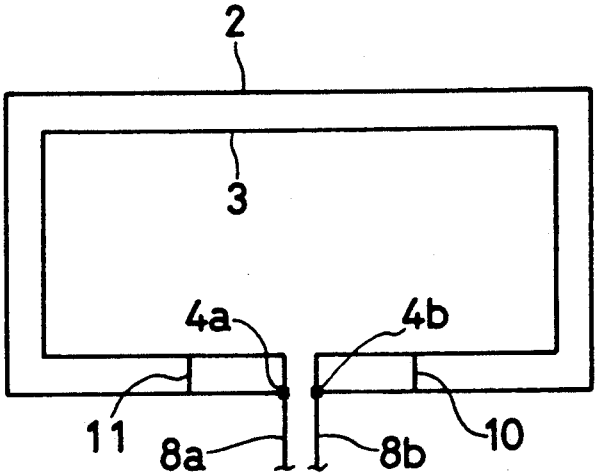

The positions of feed terminals 4*a* and 4*b* can be modified in accordance with applied loop figures. Some illustrations of feed points for a rectangle loop antenna are shown in FIGS. 6A–6C. Location of feed points may be selected from three types: a shorter side feeding as in FIG. 6A, a vertex feeding as in FIG. 6B and a longer side feeding as in FIG. 6C. For other types of loop antenna, the feed terminals can be located so as to optimize a frequency characteristic of their input impedances.

Short-circuiting lines are provided according to the above-mentioned embodiments to divide a parasitic loop produced in a double loop antenna so that a higher order resonance frequency is shifted outside of the operative band of the antenna. Thus degrading of antenna impedance characteristic due to the higher order resonance is improved and a double loop antenna with remarkably wide-band reception characteristic is obtained.

Figure 7:
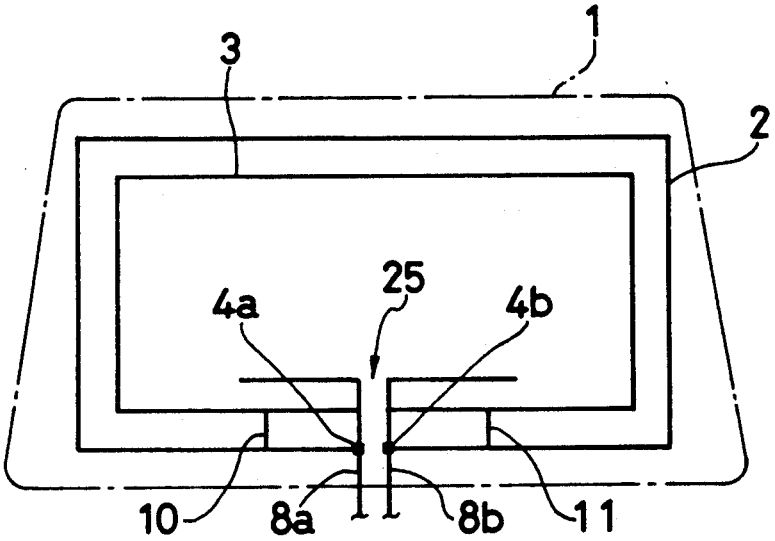
FIGS. 7 and 8 are front views of a rear glass window of an automobile according to the second embodiment of this invention.

FIG. 7 is a front view of a rear window glass of an automobile according to the second embodiment of this invention. The rear window glass 1 is shaped into a generally oblong rectangle, along the periphery of which an outer loop antenna 2 is arranged. The outer loop antenna 2 is therefore shaped into an oblong rectangle with longer and shorter sides in a ratio of 2:1.

An inner loop antenna 3 having a similar figure with the outer loop antenna 2, that is, a rectangle loop antenna with sides with a ratio of 2:1 is arranged inside the outer loop antenna 2. A dipole antenna 25 is additionally arranged inside the inner loop antenna 3.

The perimeters of the loop antennas 2 and 3 are fixed to resonate at respective frequencies of FM broadcast waves. The outer loop antenna 2 resonates with a wave at a lower frequency and the inner loop antenna 3 resonates with a wave at an upper frequency.

The dipole antenna 25 is tuned to receive for example a TV broadcast wave.

The outer loop antenna 2, inner loop antenna 3 and dipole antenna 25 are connected in parallel to common feed terminals 4*a* and 4*b*. Reception power induced by these antennas is derived from the feed terminals 4*a* and 4*b* and then fed to a receiver in an automobile through feeder lines 8*a* and 8*b*.

The loop antennas 2 and 3 and the dipole antenna 25 connected in parallel will interfere with each other when their resonance frequencies are set close to each other. Their resonance frequencies are therefore set to be interleaved. Generally the loop antenna shows high impedance at the wavelength of a frequency corresponding to its perimeter length or integral multiples of this frequency. A high impedance state is generated at that wavelength as if almost no conductor for the antenna is connected to the feed terminals when viewed from the feeder cable. When the loop antenna 2 or 3 having an interleaved resonance frequency $f_0$ and the half-wave dipole antenna 25 having a resonance frequency $1.5\times f_0$ are coupled in parallel with each other, the loop antenna 2 or 3 operates near the frequency $f_0$, while the dipole antenna 25 has a large impedance and acts as a capacitive load. On the other hand, when the dipole antenna 25 is operated near the interleaved frequency of 1.5 $f_0$ and, the loop antenna 2 or 3 exhibits a large impedance. Therefore, parallel connection of antennas of different types dose not cause interference. A good reception sensitivity is obtained over a wide frequency range from an FM broadcast band to a TV broadcast band. In addition, the number of feeder cables for feeding reception power to receivers in an automobile can be reduced so that the periphery of the window is simplified and wiring work is reduced.

Figure 8:
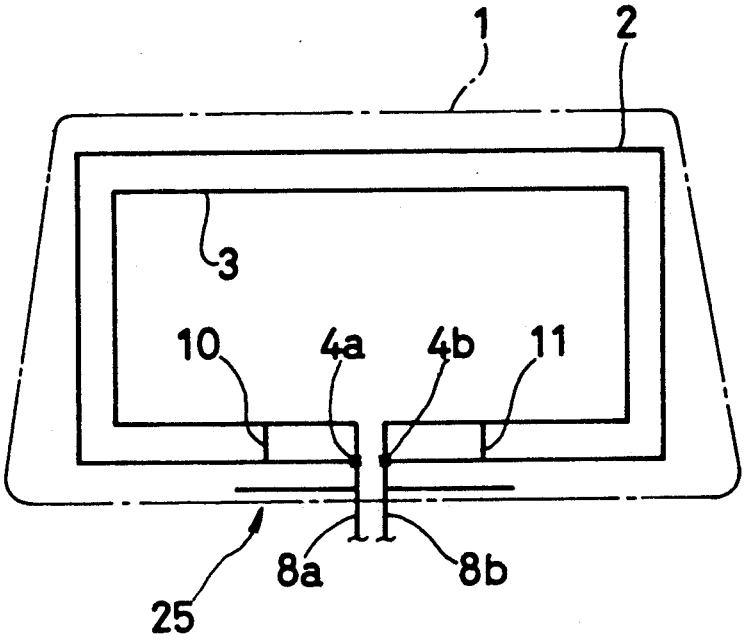

As shown in a front view of a rear window glass of FIG. 8, the dipole antenna 25 may be arranged outside the outer loop antenna 2. Other non-loop antenna than the dipole antenna can be coupled on condition that its resonance frequency differs enough from that of the loop antenna.

In the second embodiment, utilizing the fact that a loop-like antenna shows high impedance in frequency bands except in the vicinity of frequencies which are multiples of its natural oscillation frequency, a non-loop antenna having a resonance frequency in one of the high impedance bands is coupled thereto. A wide-band characteristic is obtained with a simple conductor pattern. A single feed point can simplifies the cable wiring between the antenna and a receiver.

Figure 9A:
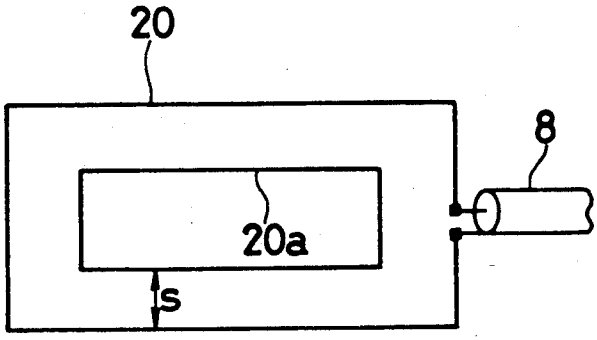
FIGS. 9A–9C are essential conductor patterns of a loop antenna according to the third embodiment of this invention.
Figure 9B:
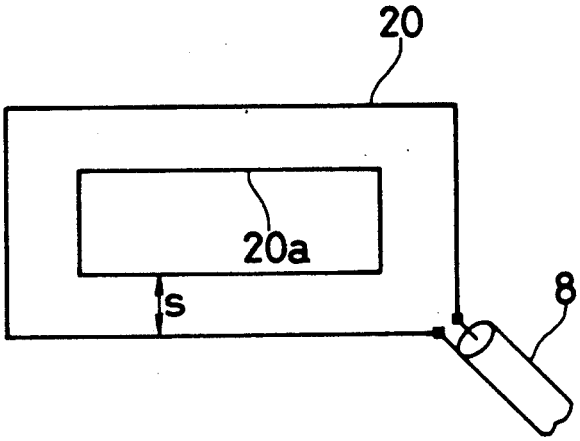
Figure 9C:
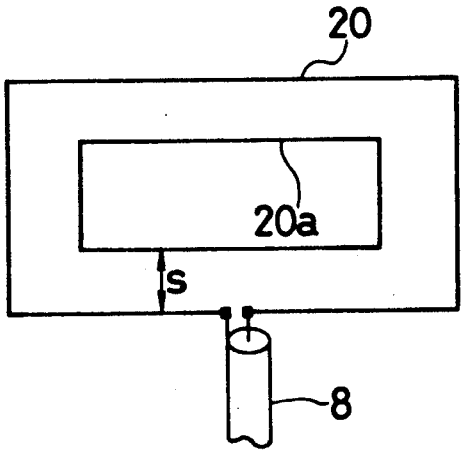

FIGS. 9A–9C are views of antenna patterns illustrating an essential feature of a window glass antenna according to the third embodiment of this invention. Types in FIGS. 9A–9C are identical with respect to conductor pattern except their feeding configuration. A parasitic loop 20*a* is loaded inside an outer loop antenna 20 shaped into an oblong rectangle with longer sides and shorter sides in a ratio of 2:1.

The outer loop antenna 20 is formed to have a total length of 3.4 m and is used for FM broadcast reception antenna. The parasitic loop 20*a* is formed in a similar rectangle figure with the outer loop antenna 20. A uniform interval S is provided between the outer loop antenna 20 and the parasitic loop 20*a* along the circumference thereof.

Figure 10:
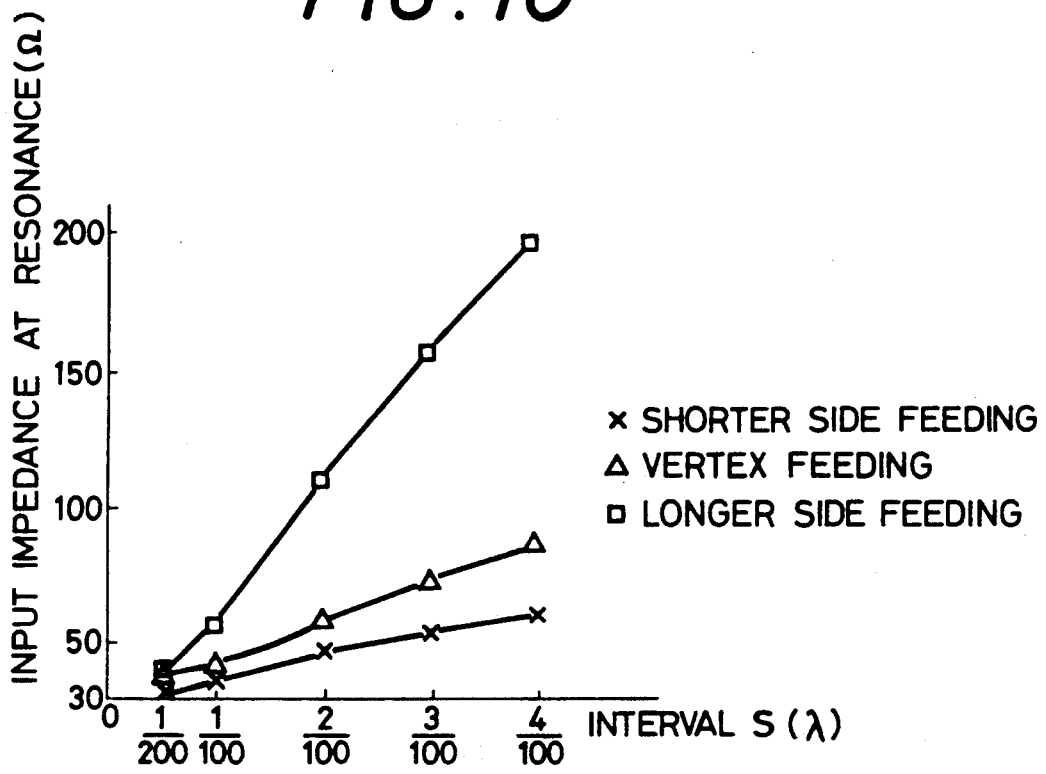
FIG. 10 is a graph showing an impedance characteristic of the antennas in FIGS. 9A–9C.
Figure 11:
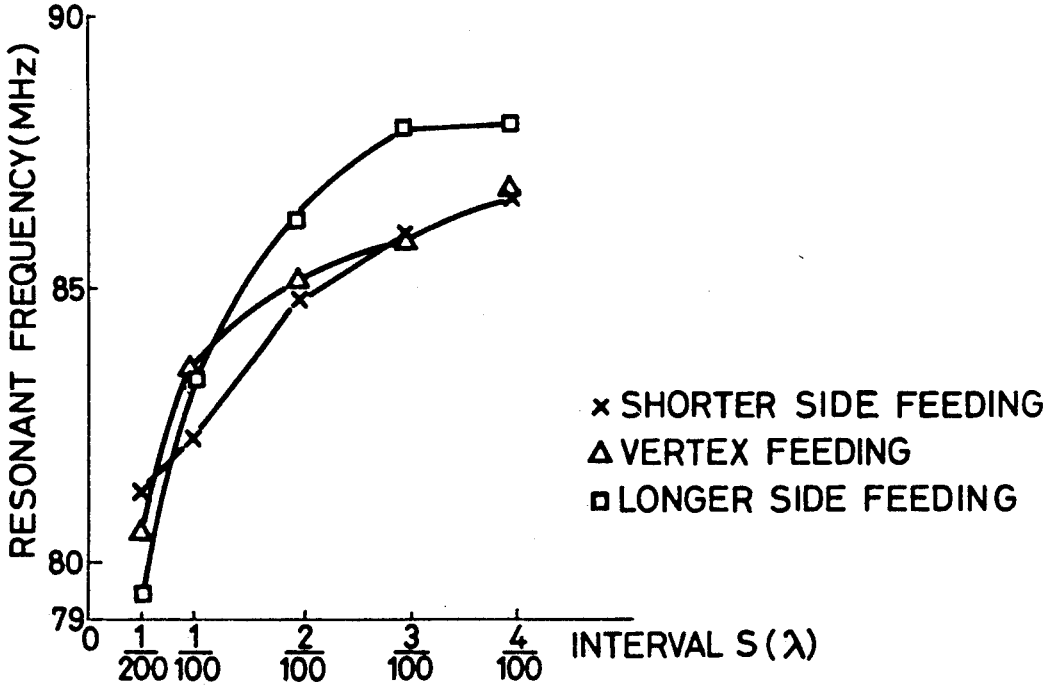
FIG. 11 is a graph showing a frequency characteristic of the antennas in FIGS. 9A–9C.

As the interval S is changed, the characteristics of the outer loop antenna 20 varies. FIG. 10 shows a relation between the interval S and input impedance of the antenna at resonance point and FIG. 11 shows a relation between the interval S and resonance frequency. In FIGS. 10 and 11, the curve along X-marks is a characteristic of the shorter side feeding type of FIG. 9A, a curve along Δ-marks is a characteristic of the vertex feeding type of FIG. 9*b* and a curve along □-marks is a characteristic of the longer side feeding type of FIG. 9C. The interval S is represented in fractions of a wavelength of an operating frequency in respective figures.

As apparent from FIG. 10, input impedances are different in accordance with feeding types, and in respective types, the smaller the interval S decreases to make the parasitic loop 20*a* close to the outer loop 20, the lower the input impedance at resonance condition becomes. The variation of the input impedance for the longer side feeding type appears to be remarkable. The input impedance is decreased below 50 [Ω] for intervals as small as 1/200 of a wave-length, while the impedance is almost 300 [Ω] for a loop antenna without the parasitic loop 20*a*.

In the longer side feeding, type it is regarded that a λ/2 dipole antenna is formed along each upper and lower sides of the loop antenna 20. With insertion of the parasitic loop 20*a* between these two dipole antennas, mutual coupling between the dipole elements on upper and the lower sides is reduced significantly and in addition self-impedance of the loop antenna 20 is lowered in accordance with change of conductor width due to close arrangement of the parasitic loop 20*a*. The input impedance is thus reduced.

Resonance frequency varies as the interval S changes as shown in FIG. 11. This means that resonance frequency varies along with variation of the input impedance. For the longer side feeding type, it appears that the parasitic loop 20*a* influences only the input impedance for values of the interval S more than 3/100 of wavelength (λ) and the resonance frequency approaches to that of a single loop.

As discussed above, the input impedance of the antenna can be changed by changing the interval S so that the loop antenna can be matched with a feeder cable without any special matching circuit.

In the examples in FIGS. 9A–9C, the parasitic loop 20*a* is arranged inside the outer loop antenna 20. An inner loop antenna with a parasitic loop may be arranged inside the outer loop antenna 20 with the parasitic loop 20*a*. In this modification, the inner loop antenna and the outer loop antenna may be coupled in parallel to a feed terminal to derive reception power therefrom.

Figure 12:
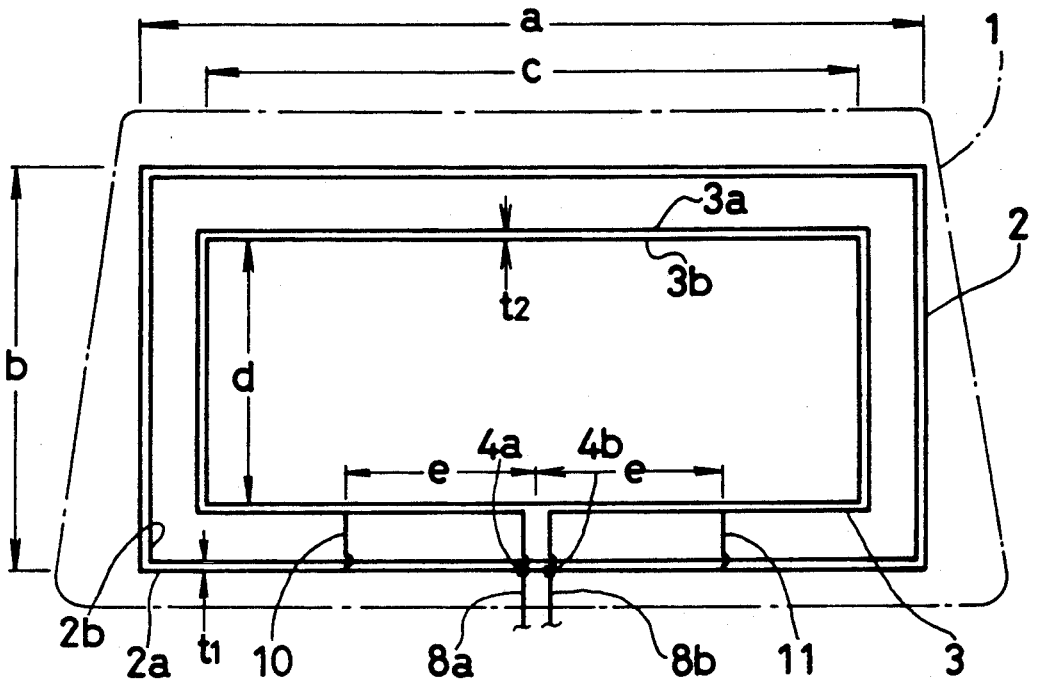
FIG. 12 is a front view of a rear window glass of an automobile employing a loop antenna according to the FIGS. 9A–9C.

FIG. 12 is a front view of a rear window glass of an automobile with a window glass antenna employing the double line, double loop antenna according to a modification. The window glass 1 is generally an oblong rectangle, along the periphery of which an outer loop antenna 2 is arranged. The outer loop antenna 2 is shaped into an oblong rectangle similar to the figure of the rear window glass 1. The outer loop antenna 2 consists of two conductor lines 2*a* and 2*b* arranged with a fixed interval $t_1$ which is set to be less than 1/100 of an operating wavelength. The conductor line 2*b* serves as the parasitic closed loop. An inner loop antenna 3 consisting of two conductor lines 3*a* and 3*b* arranged with a fixed interval $t_2$ is provided inside the outer loop antenna 2. The interval $t_2$ is set to be less than 1/100 of the operating wavelength. The conductor line 3*b* serves as the parasitic closed loop. Respective ends of the conductor lines 2*a* and 3*a* of the loop antennas 2 and 3 are coupled in parallel with the common feeder lines 8*a* and 8*b* at feed terminals 4*a* and 4*b*.

Figure 13:
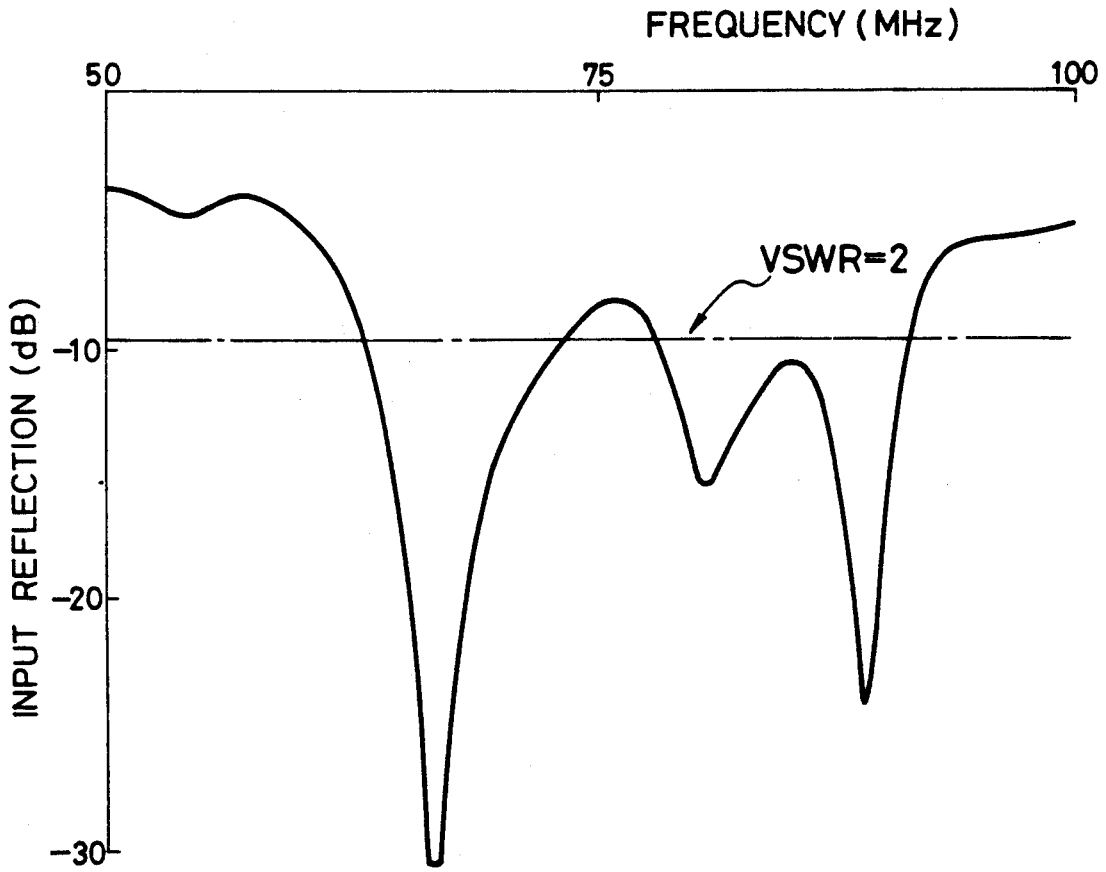
FIG. 13 is a graph showing a reflection characteristic of the loop antenna in FIG. 12.

FIG. 13 shows a characteristic of input reflection ratio of the double loop antenna in the embodiment of FIG. 12 in which conductor intervals are set to be $t_1=15$ mm and $t_2=15$ mm and the conductors are coupled at the feed terminals 4*a* and 4*b* to the feeder lines 8*a* and 8*b* with a characteristic impedance of 50 [Ω]. A good matching characteristic is obtained with VSWR less than 2 in an FM broadcast band ranging 70–90 MHz.

Figure 14:
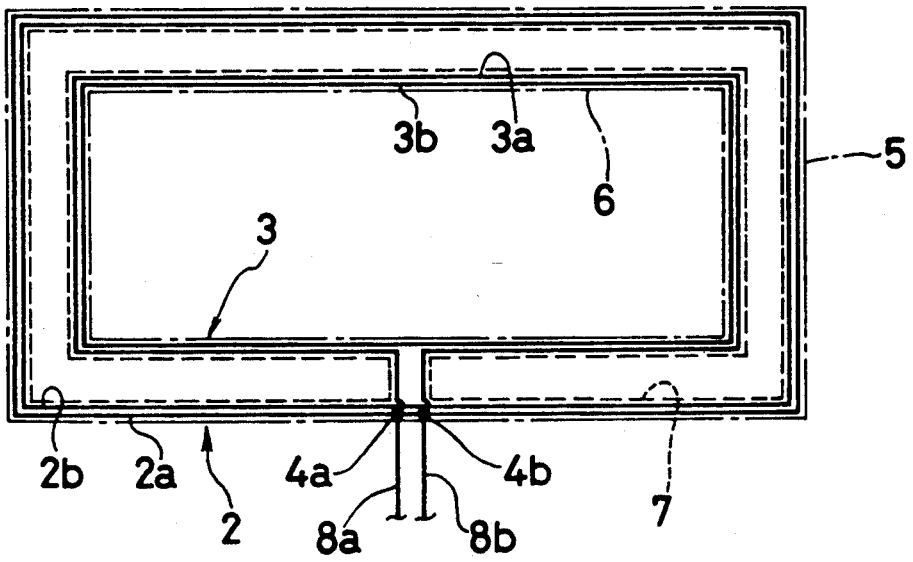
FIG. 14 is an illustration of closed loops formed by two loop antennas.

As shown by a closed loop illustration of FIG. 14, it appears that a third closed loop 7 is parasitically formed in addition to a main loop 5 corresponding to the outer loop antenna 2 and a subsidiary-loop 6 corresponding to the inner loop antenna 3 when these antennas are coupled in parallel at the feed terminals 4*a* and 4*b* as in the embodiment of FIG. 12. A loop length of the third loop 7 corresponds to a sum of the lengths of the main loop 5 and the subsidiary-loop 6.

The third parasitic loop 7 is about 7,140 mm in the example of FIG. 12 having sizes: a=1,250 mm, b=625 mm, c=1,130 mm and d=505 mm to receive an FM broadcast wave. Therefore, the third loop 7 theoretically has a resonance frequency of 84 MHz when it operates as a second harmonic antenna. A degraded dip is generated in an impedance characteristic between the resonance frequency of the main loop 5 and the resonance frequency of the sub-loop 6.

To improve the disadvantage, in this embodiment, short-circuit lines 10 and 11 are provided as shown in FIG. 12 to give short-circuits between the conductor 2*a* of the outer loop antenna 2 and the conductor 3*a* of the inner loop antenna 3 for dividing the third loop 7. The second harmonic resonance frequency of the third loop 7 is shifted upward outside the operation band. The degrading of the input impedance characteristic due to the third loop 7 is improved so that a glass antenna with sufficient wide-band characteristic is obtained over a whole range of an FM broadcast band.

The short-circuiting lines 10 and 11 may be a single wire or a stranded wire or may be formed of a printed wire. In the latter case, an insulation layer is formed on the conductor line 2b and then printed wiring is provided thereon.

According to an experiment, a good wide-band characteristic is obtained with a distance e=312.5 mm from the respective feed terminals 4a and 4b to short-circuiting points. The short-circuited double loop antenna having the above configuration shows a VSWR less than 2 in an FM broadcast band of 73-90 MHz. This FM reception antenna satisfies requirements for good radio reception.

The loop antenna may be a multiloop such as a triple loop or more.

According to this third embodiment, double loop antenna conductors one of which forms a parasitic closed loop are arranged on a dielectric plate with a narrow interval therebetween which is set to tune an input impedance of the antenna conductor. The antenna matches a feeder cable without any matching circuit.

Having described a specific preferred embodiment of the present invention with reference to the accompanying drawings, it is to be understood that the invention is not limited to that precise embodiment, and that various changes and modifications may be effected therein by one skilled in the art without departing from the scope or spirit of the invention as defined in the appended claims.

What is claimed is:

1. A wide-band loop antenna comprising:

a main loop conductor provided on a dielectric plate and extending from a first feed terminal to a second feed terminal to form a one-turn loop;

a subsidiary loop conductor provided on the dielectric plate and extending parallel to the main loop conductor to form a one-turn loop, said main and subsidiary loop conductors being connected to said feed terminals to provide a closed circuit;

a first short-circuit line connected between said main and subsidiary loop conductors at a position adjacent said first feed terminal; and a dipole antenna connected to said feed terminals.

2. A wide-band loop antenna according to claim 1, wherein said closed circuit has an inherent resonance frequency and said dipole antenna has a resonance frequency that is not a multiple of said closed circuit inherent resonance frequency.

3. A wide-band loop antenna comprising:

a main loop conductor provided on a dielectric plate and extending from a first feed terminal to a second feed terminal to form a one-turn loop;

a subsidiary loop conductor provided on the dielectric plate and extending parallel to the main loop conductor to form a one-turn loop, said main and subsidiary loop conductors being connected to said feed terminals to provide a closed circuit;

a first short-circuit line connected between said main and subsidiary loop conductors at a position adjacent said first feed terminal; and an antenna conductor not formed into a loop, said antenna conductor not formed into a loop being connected to said feed terminals, wherein said antenna conductor not formed into a loop is disposed substantially in the plane of and unencompassed by the loops formed by said main and subsidiary loop conductors.

4. A wide-band loop antenna comprising:

a main loop conductor provided on a dielectric plate and extending from one feed terminal to another feed terminal to form a one-turn loop;

a first parasitic closed loop conductor arranged substantially in the plane of and encompassed by said main loop conductor, said first parasitic closed loop extending parallel to and concentric with said main loop conductor and having a distance therebetween less than 1/100 of a wavelength of a transmission/reception wave;

a second loop conductor arranged substantially in the plane of and encompassed by said main loop conductor and having two ends, said ends being connected to the feed terminals, and a second parasitic closed loop conductor arranged substantially in the plane of and encompassed by said second loop conductor, said second parasitic closed loop conductor extending parallel to and concentric with said second loop conductor and having a distance therebetween less than 1/100 of said wavelength.

5. A wide-band loop antenna according to claim 4, further comprising a short-circuit line connected between said main and second loop conductors at a position adjacent to said feed terminals.

6. A wide-band loop antenna according to claim 5, wherein at least a pair of short-circuit lines is provided at respective points located at equal distances from said feed terminals.

* * * * *